United States Patent [19]

McKinney et al.

[11] 4,097,362

[45] Jun. 27, 1978

[54] METHOD FOR ENHANCING DISTILLATE LIQUID YIELD FROM AN ETHYLENE CRACKING PROCESS

[75] Inventors: Joel Drexler McKinney; Raynor T. Sebulsky, both of Pittsburgh; Francis Edmund Wynne, Jr., Allison Park, all of Pa.

[73] Assignee: Gulf Research & Development Company, Pittsburgh, Pa.

[21] Appl. No.: 704,392

[22] Filed: Jul. 12, 1976

[51] Int. Cl.[2] ..... C10G 37/02; C10G 9/32; C07C 11/04

[52] U.S. Cl. ..... 208/78; 208/48 Q; 208/57; 208/113; 208/127; 208/216; 260/683 R

[58] Field of Search ..... 208/78, 52 R, 67, 50, 208/53, 54, 48 R, 48 Q, 125, 126, 127, 130; 260/683 R

[56] References Cited

U.S. PATENT DOCUMENTS

| | | | |
|---|---|---|---|
| 2,422,501 | 6/1947 | Roetheli | 208/153 X |
| 2,445,351 | 7/1948 | Gohr | 208/159 |
| 2,731,508 | 1/1956 | Jahnig et al. | 260/683 |
| 2,879,224 | 3/1959 | Lawson | 208/100 |
| 2,943,994 | 7/1960 | McCain | 208/48 |
| 2,946,741 | 7/1960 | Miller | 208/127 |
| 3,039,955 | 6/1962 | Honnold | 208/132 |
| 3,758,400 | 9/1973 | Hampton | 208/72 |
| 3,812,029 | 5/1974 | Snyder | 208/113 |
| 3,928,173 | 12/1975 | James | 208/78 |
| 3,984,305 | 10/1976 | Hosoi et al. | 208/57 |

*Primary Examiner*—Delbert E. Gantz
*Assistant Examiner*—G. E. Schmitkons

[57] ABSTRACT

In a thermal cracking process employing inert hot solids as a heat source, the cracker effluent solids are passed to a burner for combustion of deposited and entrained coke. The liquid product of the thermal cracking process is distilled and the liquid residue comprises a low value solids-containing slurry which is used as a torch oil in the coke burner. The liquid residue from a catalytic cracking process also comprises a low value slurry since it contains particles of cracking catalyst and in the present process is used as auxiliary torch oil in the solids burner. The catalyst particles are rendered inert at the high temperature of the burner, thereby enhancing the quantity of inert solids circulating in the thermal cracking process. The use of a second slurry as torch oil reduces the quantity of thermally cracked liquid residue required as torch oil and enhances the quantity of more valuable solids-free distillate liquid recoverable from the thermal cracking process.

8 Claims, 2 Drawing Figures

METHOD FOR ENHANCING DISTILLATE LIQUID YIELD FROM AN ETHYLENE CRACKING PROCESS

Figure 1:
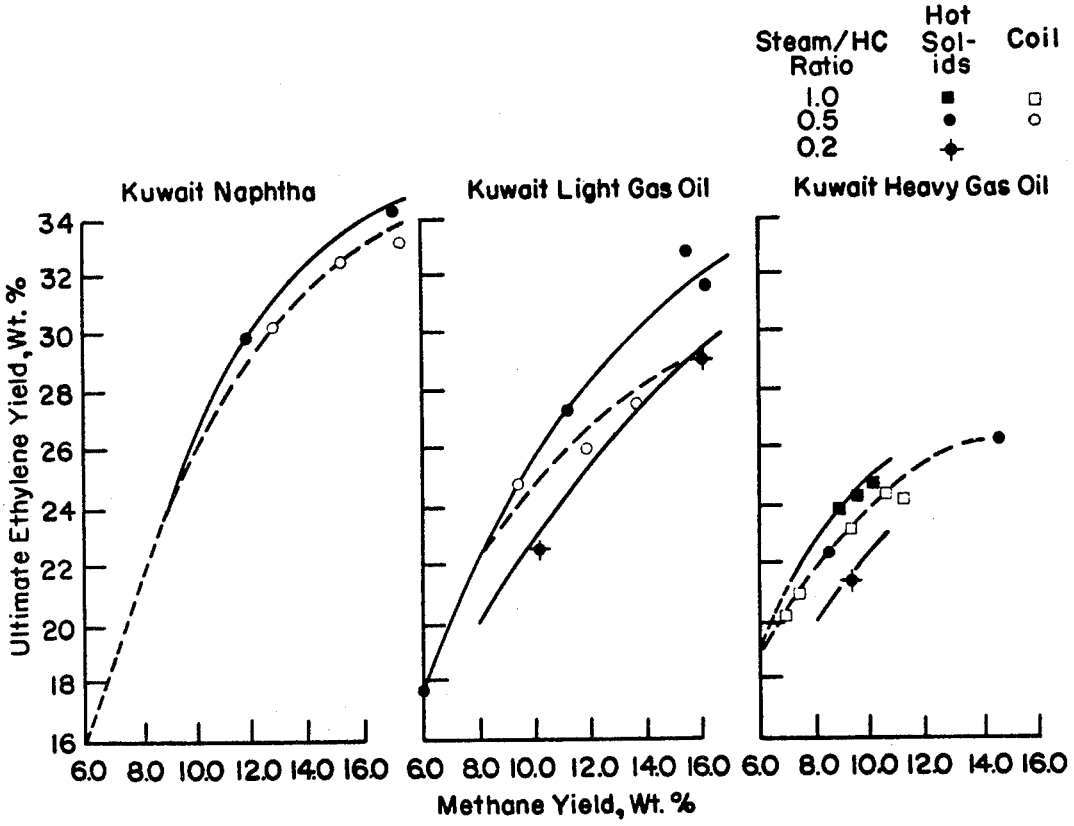

This invention relates to a process involving both thermal and catalytic cracking of hydrocarbon oils.

The thermal cracking operation of this process is directed towards the recovery of gaseous olefins as the primarily desired cracked product, in preference to gasoline range liquids. At least 15 or 20 weight percent of the feed oil is converted to ethylene. While ethylene is the single most prevalent gaseous product most of the feed oil is converted to both other gaseous products and to liquid products. Other valuable hydrocarbon gaseous products include propylene and 1,3-butadiene. Other $C_4$'s and ethane are also produced. Hydrogen is recovered as a valuable non-hydrocarbon gaseous product. Liquid products are produced in the cracking process by combination of intermediate olefinic material in the reactor and can comprise 40 or 50 weight percent or more of the total product. Recovered liquid products include benzene, mixtures of benzene, toluene and xylenes (BTX), gasoline boiling range liquids and light and heavy gas oils. The economic value of the various gaseous and liquid hydrocarbon products is variable and depends upon prevailing market conditions. Coke is a solid product of the process and is produced by polymerization of unsaturated materials. Most of the coke formed is removed from the process as a deposit upon the entrained inert heat carrier solids.

The proportions of the various products obtained depend significantly upon cracking severity, which can be expressed in terms of methane yield since methane is the ultimate hydrocarbon product. At a low severity, i.e. at methane yields below about 4 or 6 weight percent based on feed oil, yields of most products will be low. At a moderate severity, i.e. at methane yields above about 4 or 6 but below about 12 or 14 weight percent, optimum yields of intermediate olefins such as propylene and 1,3-butadiene will be realized. At high severities, i.e. at methane yields above about 12 or 14 weight percent, yields of propylene and 1,3-butadiene will decline and yields of very light materials, such as methane, hydrogen, and ethylene will tend to increase.

In the thermal cracking operation, a stream of hot solids supplied at a temperature above the average thermal cracker temperature is mixed with feed oil and a gaseous diluent, such as steam or other vapor, both supplied at a temperature below the average cracking temperature. There is no need to charge gaseous hydrogen to the thermal cracker. The components in the resulting mixture of feed oil, gaseous diluent and entrained solids flow concurrently through the thermal riser at an average riser temperature of 1,300° to 2,500° F. (704° to 1,371° C.) for a residence time between about 0.05 and 2 seconds. Endothermic cracking occurs in the thermal cracker so that the highest temperature occurs near the inlet of the riser, with the temperature falling slightly and gradually along the length of the riser. The thermal cracking reactor is elongated and has a high length to diameter ratio in the range of 4:1 to 40:1, generally, or 6:1 to 20:1, preferably. The reactor can be disposed either vertically or horizontally. Direction of flow is not important and in a vertically disposed riser flow can be directed either upwardly or downwardly. Most commonly, the reactor will be an elongated riser with preheated feed oil, steam diluent and hot solids flowing concurrently upwardly or downwardly through the riser at a sufficiently high velocity that the heat carrier solids are carried in entrained flow through the riser by flowing vapors. More than 98 or 99 percent of the hot solids flowing to the riser are recirculated solids. Essentially the only solids bled off from the solids circulation system are solids or ash contained in the feed oil or very fine solids resulting from attrition of the heating solids. The size of the entrained solid particles is not important as long as the solids are sufficiently small that there is little or no slippage between the inert solids and the flowing gases. Henceforth, for convenience the thermal cracking reactor will be considered to be a vertical upflow riser with steam as the diluent vapor.

The thermal reactor of the present invention is to be distinguished from a coil thermal cracking reactor which does not utilize hot solids as an internal heat carrier agency but wherein feed oil and steam diluent flow occurs through a coil disposed in a radiant, reflective furnace chamber enclosing an open flame. In the coil type reactor the flowing stream progressively becomes heated in transit through the coil so that the stream is at its lowest temperature at the coil inlet and progressively becomes heated during passage through the coil so that it is discharged from the coil at its highest temperature. Because a coil reactor is dependent for its heat requirements upon heat transfer across the wall of the coil and along the cross-section of the coil, the diameter of the coil must be considerably smaller than the diameter of the thermal riser of the present invention in order to provide a high ratio of heat transfer surface to tube cross-section. The thermal riser of the present invention can have a considerably larger diameter than the coil reactor since all the heat is added directly to the interior of the riser by means of hot inert solids. Most of the heat is carried into the interior of the riser by the hot inert solids while a smaller portion of heat is carried into the riser by diluent steam and preheated oil. Therefore, no heat transfer is required across the riser wall. Due to the endothermic nature of the reaction and because heat is not added across the reactor wall, the maximum inlet riser temperature gradually declines along the length of the reactor. This temperature gradient along the reactor is opposite to that of the coil reactor wherein a gradual temperature increase occurs along the length of the coil due to continual inward transfer of heat across the coil wall from the surrounding flame. The use of hot inert solids as a heat source is considerably more thermally efficient than an external flame because the temperature of the flame surrounding a coil cracker is generally about 2,800° F. (1,538° C.), while the temperature of the hot solids supplied to a riser is typically about 1,700° F. (927° C.).

During operation of the coil reactor, coke is continually deposited upon the walls of the coil. Because of the small diameter of the coil, e.g. about 5 inches (12.7 cm), or less, any deposited coke forms a relatively thick layer, thereby severely inhibiting further heat transfer across the coil and tending to plug the coil. Therefore, a coil cracker cannot tolerate more than about 0.5 weight percent conversion of the feed oil to coke. If coke conversion is above this level, frequent and costly decoking with steam or air is required. Therefore, the coil reactor is most efficiently used for cracking ethane, propane, butane and light oils, such as naphtha, and exhibits greatly depressed ethylene yields when the charge comprises a heavier oil, such as light gas oil or heavy gas oil. When cracking heavier oils, the coil cracker cannot operate at as high severities, as indicated by methane yield, as the process of the present invention, since coke deposits tend to increase with increasing cracking severity. This coking tendency is so pronounced with residual oils that cracking of residual oils in a coil cracker to produce olefins is not considered to be a feasible operation.

The oil feed to a coil cracker does not generally require desulfurization because although the coke formed contains most of the sulfur content of the feed oil, it is not subsequently burned. In contrast, the coke deposited on the solids of the present process is subsequently continuously burned in an external burner so that the sulfur in the feed oil is continuously emitted to the atmosphere as sulfur oxide pollutant. Therefore, in the present process if prevailing air pollution standards are to be met without resorting to stack gas scrubbing, high sulfur feed oil must be desulfurized to an extent which results in a sulfur oxide emission less than about 250 to 500 ppm by volume in the burner flue gas.

It is a particular advantage of the present process that some of the hydrogen consumed during desulfurization of the feed oil is recovered as molecular hydrogen. The hydrogen that is recovered is the hydrogen that is chemically combined with the hydrocarbon molecule, as contrasted to hydrogen that is converted to hydrogen sulfide. This hydrogen can be recovered since the high temperature thermal cracking process yields an olefinic product by splitting the relatively stable hydrogen to carbon bonds to produce free hydrogen, in addition to splitting the less stable carbon to carbon bonds. The present thermal cracking process is thereby contrasted to lower temperature cracking processes wherein the product is primarily paraffinic because cracking occurs by splitting carbon-carbon bonds and stops short of splitting the more stable carbon-hydrogen bonds.

Operation of the thermal riser of the present invention is not limited by coke formation on the reactor wall as in the case of the coil reactor because heat transfer across the reactor wall is not required and because the hot solids entrained in the reactor stream provide both a surface for the deposit of coke and a vehicle for its removal. Thereby, the entrained solids continuously carry off from the reactor most of the coke as it is formed. When heat is supplied internally, rather than across the riser wall, the diameter of the riser can be very large, for example about 30 to 40 inches (76.2 to 101.6 cm). Although most of the coke formed is carried out of the riser as particulate coke both on and off of the solids, some is dissolved in the heavy oils produced in the riser.

The entrained coke-coated solids leaving the thermal riser are passed to a burner wherein the coke is burned from the surface of the solids to both remove the coke and to heat the solids and thereby supply the required heat for the thermal cracking reaction during the next pass. While complete burn off will usually take place, such is not necessary and some coke can be recycled on the solids. Continuous addition to and removal of solids from the burner moderates combustion temperature and thereby tends to reduce or prevent formation of noxious nitrogen oxides from nitrogen present in the combustion air, which can occur during high temperature combustion. Since the solids do not normally contain sufficient coke to adequately heat the solids, supplementary fuel is supplied to the burner in the form of torch oil. Hot, substantially coke-free solids are continuously removed from the burner and are recycled to the bottom of the thermal cracking riser to provide heat thereto. The thermal cracking process of the present invention requires a supply of hot solids at only a single temperature for admixture with feed oil to accomplish cracking and does not require a plurality of solid streams at different temperatures.

Use of inert solids to continuously carry coke deposits from the reactor, rather than permitting them to accumulate within the reactor and plug it, permits thermal cracking to be performed at a high severity. Thermal cracking at a high severity can be an advantageous mode of operation. Although propylene and butadiene yields reach a peak at moderate severities and then decline, the yields of other highly valuable products tend to increase with increasing severity, including ethylene (which tends to attain a relatively flat, elevated yield level at high severities), methane, aromatics and hydrogen. A thermal riser of this invention is capable of operating with higher boiling feedstocks, at higher severities as measured by methane yield or other severity criteria and with lower levels of steam dilution to achieve a given ethylene yield, as compared to a coil thermal cracker which does not employ hot solids.

In a thermal riser of this invention, the average riser temperature is between about 1,300° and 2,500° F. (704° and 1,371° C.), generally, between about 1,400° and 2,000° F. (760° and 1,093° C.), preferably, and between about 1,430° and 1,850° F. (777° and 1010° C.), most preferably. The feed oil can be preheated in advance of the riser, if desired, or feed oil preheating can be omitted. If the oil is preheated, any preheating temperature up to the temperature of oil vaporization or coking can be employed. Immediately upon leaving the riser, the product stream should be quenched to a temperature below about 1,300° F. (704° C.). Cold solids, water, steam and recycle oils are examples of suitable quench materials. A quench temperature below 1,300° F. (704° C.), such as between about 890° and 1,300° F. (477° and 704° C.), is suitable.

A dispersant gas, preferably steam, is supplied to the oil preheater or to the riser, if desired, in any amount up to about 2 pounds per pound (908 gm. per gm.) of hydrocarbon feed. The quantity of steam required tends to increase as the boiling point of the feedstock increases. A highly parafinic feedstock generally requires less steam than a highly olefinic or alkyl aromatic feedstock. Although the use of steam favorably influences ethylene yield and selectivity, it is a very costly factor in cracker operation. As steam consumption increases, a point approaches where the cost of additional steam and the cost of its condensation is not compensated by the incremental ethylene yield or selectivity. Every incremental increase of steam employed must be more than compensated by the value of the resulting incremental increase in yield of ethylene or other products.

The pressure employed in the riser should be adequate to force the riser effluent stream through the downstream separation equipment. The pressure will be between about 3 and 100 psig (0.2 and 7 kg/cm$^2$), generally, and between about 5 and 50 psig (0.35 and 3.5 kg/cm$^2$), preferably. A pressure above about 15 psig (1.05 kg/cm$^2$) will usually be required. The riser residence time can be between about 0.05 and 2 seconds, generally, or between about 0.05 and 0.5 seconds, preferably. Higher residence times induce either undesired olefin polymerization reactions or undesired cracking of light or heavy products. The weight ratio of solids to feed oil can be between about 4:1 and 100:1, generally, and between about 10:1 and 30:1, preferably. The hot solids can be supplied to the riser at any temperature which is at least about 50° F. (27.8° C.) above the riser outlet temperature, up to a maximum temperature of about 2,500° F. (1,371° C.). The temperature of the solids supplied to the riser will be about the temperature within the coker burner. Only one stream of solids at the desired temperature is generally required for the cracking operation. Any catalytically inert material or mixture can serve as the solid heat carrier. Suitable materials include non-catalytic alumina, alundum, carborundum, coke, deactivated catalyst, etc. Neither the particle size nor the surface area of the inert solids is critical. Any size capable of passing through the riser in entrained flow with the reactant oil and steam diluent with little or no slippage can be employed. In one particular but non-limiting example, a particle size range of 5 to 150 microns with an average size of 70 microns, was supplied to the riser. During use, the particles undergo abrasion and reduction to a smaller size. The heat content in the solids entering the riser should be sufficient to supply at least 80 or 90 percent of the heat requirements of the cracker, which is approximately 350 BTU per pound of feed oil. This constitutes the entire heat supply beyond preheat of feed oil and the heat content of the diluent gas.

In the operation of the cracker riser, since methane is the ultimate hydrocarbon cracked product, an increasing methane yield is an indication of increasing severity. There are many ways that cracker severity can be changed. For example, changes can be made in temperature, residence time, feedstock, solids to oil ratio or recycle of crackable paraffins and olefins such as ethane, propane, propylene and butane. Because the solids riser can tolerate high coke yields, wide variations in severity are possible. While coil cracking of propylene is usually avoided because of a tendency of this material to coke, the present cracking process can recycle $C_3$, $C_4$ and $C_4$+ olefins, if desired.

An additional important advantage associated with the use of a solids heat carrier to supply more than 80 or 90 percent of the total cracker heat requirement arises when relatively high boiling feed oils are employed. If heavy oil fractions are subjected to excessive preheating in a coil preheater, they would tend to coke, thereby plugging and reducing the heat transfer efficiency of the preheater. In accordance with the present invention, preheating of heavy feed oils to the extent of inducing significant cracking or coking is avoided, and significant cracking or coking first occurs in the riser in the presence of the heat carrier solids. The heavy feed oils are not subjected to the most elevated process temperatures until contact with hot solids at the bottom of the riser.

In the thermal cracker, a number of secondary reactions occur which compete with the primary cracking reactions and which necessitate the very low residence times of the present invention. Olefins present in the feedstock or produced by cracking are not only more refractory to further cracking than are paraffins, but in addition they can condense to produce benzene, toluene, xylene and other aromatics. For this reason, olefinic feedstocks tend to be improved by hydrogenation. The aromatic materials produced have a variable economic value, depending upon market conditions. Higher molecular weight aromatics are also produced. An unstable aromatic gasoline boiling range fraction is formed as well as aromatic light gas oil and heavy gas oil fractions. The higher boiling feedstocks of a given molecular type composition produce the most coke and heavy oil.

The heavier liquid product fractions can be utilized as a torch oil in the burner to supplement the fuel value of the coke on the solids. Torch oil is a lower cost fuel than the gas and naphtha fuels normally employed to provide the uniform radiant heat required in the furnace of a coil cracker. In the burner, the cokeladen solids are subjected to burning in the presence of air at a temperature above 1,700° F. (927° C.). The burner flue gases can be passed to an energy recovery unit, such as steam generator or a turbo-expander. The flue gases should contain less than about 250 to 500 ppm by volume of sulfur oxides in order to be environmentally acceptable. Otherwise, a stack gas scrubber will be required. Because of the elevated combustion temperatures, the concentration of carbon monoxide will be low even with little excess air. The relatively coke-free hot solids are returned to the riser.

The total product from the thermal riser can be separated into a plurality of distinct product fractions. The lightest fraction will comprise methane and hydrogen in a ratio of one mole of hydrogen to two moles of methane. Since an increase in methane yield is an indication of an increase in process severity, high severity processes provide the advantage of high hydrogen yields. The methane and hydrogen can be separated from each other in a cryogenic unit. The ethylene product fraction comprises the highest volume gaseous olefin product. Paraffinic feeds produce the highest ethylene yields, while aromatic feed components are refractory and do not tend to produce ethylene. As cracking temperatures and residence times increase, the ethylene yield reaches a flat maximum. Ethane, propane and propylene can each be separately recovered. A $C_4$ cut can be recovered. The $C_4$'s will comprise butanes, butenes and butadiene with traces of other $C_4$'s. Butadiene can be separated from the mixture for sale. A $C_5$–$C_{10}$ cut can be recovered as a source of gasoline and aromatics. Of the total 430° F.+ (221° C.+) heavy oil product the heaviest portion can be used as torch oil in the process burner; can be hydrotreated and sold as fuel; or can be used to produce needle coke or binder pitch. About 12 to 15 percent of the feed oil to the thermal cracker is required as fuel in the burner to reheat the solids. This fuel can be derived primarily from process coke, with supplemental fuel, if any, coming from the heaviest liquid products of the process. A coke yield of 3 to 5 weight percent based on feed will generally be supplemented as fuel with heavy oil in a quantity of up to about 15 weight percent based on feed to provide adequate process heat.

This invention relates to a combination process involving operation of the above-described thermal riser cracking operation interdependently with the operation of a fluid zeolitic catalytic cracking (FCC) process. Of a wide boiling range petroleum hydrocarbon oil, the relatively low boiling fraction comprises the most suitable feedstock for thermal riser cracking in terms of ethylene yield at a given cracking severity and steam to oil ratio, and the relatively high boiling fraction comprises the most suitable feedstock for FCC in terms of gasoline yield. A high yield of ethylene can be produced from a light gas oil feedstock in thermal cracking with a relatively low steam to oil ratio while a considerably lower ethylene yield is obtained with a heavy gas oil feedstock with even twice the steam dilution level. In contrast, the heavy gas oil is successfully cracked to gasoline in an FCC operation with a zeolite catalyst with much less than the same oil requires in a thermal cracking process for the production of ethylene. While a light gas oil feedstock to a thermal cracker requires about a 0.5 weight ratio of steam to oil, a heavy gas oil feedstock produces less ethylene with a 1.0 weight ratio, but only requires a 0.005 to 0.1 weight ratio of steam to oil as an FCC feedstock. Furthermore, heavy gas oil is superior to light gas oil as an FCC feedstock in terms of gasoline yield.

In accordance with the present invention, a wide boiling range feed oil is fractionated and the relatively low boiling fraction is utilized as a feedstock for a thermal cracking riser while the relatively high boiling fraction is utilized as a feedstock for an FCC riser. A lower ratio of steam to oil is employed in the FCC riser than in the thermal cracking riser. The thermal cracking riser and the FCC riser are operated under different temperature conditions, permitting each riser to produce its own distinctive array of products. The thermal riser cracking process is operated at a temperature of about 1,300° to 2,500° F. (704° to 1,371° C.) with entrained catalytically inert heat carrier solids and without a catalyst, while the FCC process is operated at a lower temperature in the range of about 900° to 1,100° F. (482° to 593° C.) in a riser with entrained zeolite cracking catalyst for a residence time of less than 5 seconds. The primarily desired and the major gaseous product of the thermal cracking process is ethylene, while the primarily desired and major product of the FCC process is gasoline.

While the thermal cracking operation and the catalytic cracking operation each produces its own distinctive array of products, the array of products from the FCC operation includes a significant quantity of gaseous paraffins capable of being cracked or thermally decomposed to ethylene and hydrogen in a thermal riser. Disadvantageously, these paraffins are recovered from the FCC operation in gaseous streams wherein they are considerably diluted with olefins, which are poor thermal cracker feedstocks. The present invention utilizes commonly existing process operations to perform the novel function of concentrating the paraffinic material in the FCC gaseous product streams to convert FCC product streams into a high quality thermal riser cracker feedstock rich in paraffinic components. The substantial reduction of diluting olefins avoids the unproductive passage of material through the thermal riser which would tend to reduce the useful capacity of the thermal riser and increase steam requirements.

The FCC process produces two major gaseous streams; a tail gas stream and an alkylation feed stream. The tail gas stream comprises hydrogen and $C_1$ through $C_3$, plus a trace of $C_4$, olefins and paraffins, as well as ammonia, hydrogen sulfide, carbon monoxide and carbon dioxide, and ordinarily is used as a refinery fuel. This stream is advantageously upgraded from its status of a fuel (and replaced for this purpose by less valuable liquid fuel) by passage through the existing olefin recovery unit for the effluent stream from the thermal riser. The olefin recovery unit separates thermally cracked olefins and paraffins in a series of distillation steps. In the olefin recovery unit, olefins in the FCC tail gas stream blend into the main olefin stream recovered from the thermal cracker, thereby increasing the amount of olefins available for recovery. The paraffins in the tail gas stream blend into the main paraffin stream recovered from the olefin separation unit, thereby increasing the paraffin recycle stream of the thermal riser. By passage of the FCC tail gas stream through the olefin recovery unit in advance of passage to the thermal cracker, olefins are prevented from unnecessarily passing through the thermal cracking riser and unproductively consuming capacity and increasing steam requirements therein. Passage of the FCC tail gas stream to the olefin recovery unit provides the double advantage of an enhanced volume of olefinic product coupled with an enhanced volume of paraffinic recycle gases. In addition, because of the hydrogen in the tail gas stream an enriched hydrogen stream is recovered from the thermal cracking process. These advantages are obtained through conventional use of the olefin recovery unit which is operational regardless of availability thereto of the FCC tail gas stream. In this manner, the FCC tail gas stream is upgraded from a relatively low economic status as a fuel to a higher economic status as both a petrochemical product and a petrochemical feedstock as well as to a hydrogen-rich stream, while utilizing only existing process equipment.

The alkylation feed stream from the FCC process comprises primarily $C_3$ and $C_4$, plus a trace of $C_2$, olefins and paraffins. This stream is ordinarily passed through an alkylation plant which includes a paraffin-olefin distillation separation unit to preremove some of the paraffins followed by an alkylation reactor where $C_3$ and $C_4$ olefins and isobutane react in the presence of an acid catalyst such as sulfuric acid, hydrochloric acid or hydrofluoric acid to form alkylate gasoline, providing an effluent stream containing unreacted ethane, propane and normal butane. Thereby, the alkylation plant provides an effluent gaseous stream comprising unreacted $C_2$, $C_3$ and normal $C_4$ paraffins, having a greatly diminished olefinic level. In this manner, the alkylation plant serves the function of concentrating the paraffinic constituents in the FCC alkylation stream. Conventionally, this paraffinic stream has been employed as a fuel. However, the concentrated $C_2$, $C_3$ and $C_4$ paraffin stream recovered from the alkylation unit comprises a high quality thermal cracker feedstock and advantageously is passed to the thermal cracker, either in blend with or independently of the recycle system. Thereby, a gratituous function is obtained from a gasoline alkylation unit associated with an FCC riser, which is in operation independently of the thermal cracker. The alkylation unit is therefore the link providing interdependent functioning of the FCC and thermal cracker operations to accomplish the economic upgrading of a portion of the FCC cracked gases from status as a gaseous fuel to a highly paraffinic petrochemical feedstock.

Further interdependence between the alkylation unit and the thermal cracking process can be achieved by disposing of spend acid sludge from the alkylation unit in the burner of the thermal cracking process. For example, HF alkylation catalyst can be disposed of in the burner by also charging to the burner an alkaline solid fuel, such as oil shale. The oil shale contains an alkaline solid, such as calcium oxide, which will react with the HF to form a salt, such as $CaF_2$. The calcium fluoride formed is stable at the temperature of the burner and can circulate in the thermal cracking system as a heat carrier solid, and can be removed in part as fines in the dust collection system of the process. In this manner, the HF is disposed of while recovering its heat of combustion and converting it into a solid material capable of further process utility.

It is seen that in accordance with this invention, a heavy gas oil which would require a steam to oil weight ratio of about 1 if it were thermally cracked is instead catalytically cracked in an FCC unit with less than 0.1 pounds of steam per pound of oil to produce a substantial yield of $C_2$, $C_3$ and $C_4$ paraffin and olefin gases. The paraffins in these cracked paraffin gases are subsequently concentrated and thermally cracked to produce ethylene and hydrogen in a light gas oil thermal cracker utilizing a steam dilution weight ratio of only 0.5, or less. In this manner, a portion of a heavy gas oil fraction is ultimately thermally cracking at a considerably lower steam dilution level than would be required if it were directly thermally cracked as a gas oil. Furthermore, the light paraffinic gases passed to the thermal cracker can be thermally cracked with a much lower level of steam dilution than its liquid precursor.

FIG. 1 shows that in a thermal cracker progressively higher ethylene yields are achieved along with progressively lower steam dilution levels as the boiling point of the hydrocarbon feed decreases, with higher ethylene yields being achieved in a thermal cracker of this invention than in a thermal cracker that does not utilize hot solids (coil cracker). FIG. 1 shows the ultimate ethylene yield (which is the ethylene yield plus 0.8 times the sum of the ethane and acetylene yields) obtained by thermally cracking Kuwait naphtha, Kuwait light gas oil and Kuwait heavy gas oil in both a thermal cracker employing hot inert solids and in a coil cracker disposed within a furnace and without the use of hot solids. As seen from FIG. 1, the ethylene yield obtained from the heavy gas oil feedstock utilizing a steam/oil weight ratio of 1.0 was considerably lower than the ethylene yield obtained from the light gas oil feedstock utilizing a steam/oil weight ratio of only 0.5. FIG. 1 clearly shows the low ethylene yields and steam economy obtained by thermal cracking of heavy oils, indicating the advantage of utilizing relatively heavy oils as FCC feedstocks.

The data of FIG. 1 illustrate the advantage of utilizing paraffinic cracked gases from an FCC operation as thermal cracker feedstock. These gases constitute a lower boiling thermal cracker feedstock than even a naphtha oil, and therefore require a lower steam/hydrocarbon ratio. By combining FCC and thermal cracking operations as described herein, a heavy feed oil which would require an excessive steam/oil ratio if it were thermally cracked is, instead, catalytically cracked to provide light paraffin gases which are thereupon thermally cracked with a very low steam/hydrocarbon ratio. FIG. 1 shows that the advantage of utilizing the paraffinic cracked gases from an FCC operation is greater in a thermal cracker utilizing hot solids than in an externally heated thermal cracker (coil cracker) because of the higher ethylene yields achievable with the thermal cracker utilizing hot solids.

As indicated above, the heat for the thermal cracking process is obtained by burning coke deposited on the inert solids. However, the amount of coke deposited on the solids during the cracking of many feedstocks constitutes insufficient fuel for generating total process heat requirements. Therefore, a significant portion of the heavy gas oil liquid product obtained from the thermal cracking process is often utilized as supplementary fuel. This heavy liquid product is generally obtained from the bottom of a thermally cracked liquid distillation column and contains slurried particles of inert solids carried from the thermal riser. If a considerable quantity of such supplementary fuel is required, the distillation column will be operated to supply a bottoms liquid having a relatively low cut point. When this occurs, product oil of an increasingly high value will be channeled to the burner as torch oil to supply process heat.

In the FCC process, the FCC cracked liquid distillation column also yields a residual liquid which contains solid material, known as decanted oil. In the case of the FCC cracked bottoms oil, it is zeolite catalyst which is the slurried solid. The FCC cracked residual oil is highly aromatic as evidenced by a low ratio of hydrogen to carbon, and is therefore a very refractory cracker feedstock. This oil is ordinarily used to prepare relatively low value carbon black. However, the value of this oil can be increased by blending it with the solids-containing thermally cracked bottoms oil and supplying the blend to the burner as torch oil to supply a portion of the heat requirements for the thermal cracking process. The zeolite catalyst particles in the decanted oil do not constitute a detriment because these particles are about the same size as the inert solids used in the thermal riser and when the solids-containing liquid blend is burned the high temperature in the burner will deactivate the catalyst particles rendering them catalytically inert and suitable for circulation to the thermal riser as inert heat carrier solids. In this manner, the slurried zeolite catalyst particles augment the quantity of circulating inert solids in the thermal cracking process.

The use of the FCC decanted oil as a fuel rather than as a source of carbon black represents a more efficient use of this oil. The decanted oil stream is ordinarily unsuited for use as a fuel not only because it contains solids but also because it contains the highest sulfur-level of any stream from the FCC unit, due to the fact that it comprises the highest boiling components of the FCC feed oil. About 65 to 70 percent of the sulfur content of the feed oil of both the FCC and thermal cracking process is ultimately concentrated in the coke and the cracked heavy oil product of the respective processes. Because of its high sulfur level, the decanted oil may not meet air pollution standards for combination as a fuel oil without resorting to the use of a stack gas sulfur oxide scrubber. Generally, air pollution standards require a flue gas sulfur oxide content of less than about 250 to 500 parts per million by volume in order to avoid the use of a stack gas scrubber. A fuel oil cannot contain more than the amount of sulfur which will produce a flue gas meeting this requirement. Advantageously, when the decanted oil is used as a fuel in the burner of the thermal cracker process its flue gases are diluted with the flue gases produced by combustion of the carbon on the inert solids from the thermal cracker and also with the flue gases produced by combustion of the thermally cracked residual oil, both of which have a lower sulfur level than the FCC decanted oil because they are derived from a lighter feed oil. In this manner, the average sulfur level of the combined burner fuels can provide an environmentally acceptable flue gas sulfur oxide emission level without employing a sulfur oxide scrubber.

The FCC decanted oil advantageously can be introduced into the thermal cracking operation at a riser discharge line which contains hot solids and gaseous products so that the decanted oil provides a temperature quenching effect in advance of its arrival at the burner.

The blending of the solids-containing residual oil streams from the two cracking operations provides still another advantage in addition to an upgraded use for FCC decanted oil (use as a fuel rather than a coke precursor) and in addition to an advantageous additional utilization of the entrained zeolite catalyst particles. Because the two residual oil streams are blended to expand the pool of high boiling residual oil available, each residual oil can be cut at a higher temperature than would otherwise be possible. In this manner, the distillation column for the FCC cracked liquid and the distillation column for the thermally cracked liquid can each be operated to supply a solids-containing bottoms liquid oil having a much higher cut point than is otherwise possible. In turn, a greater volume of both FCC cracked distillate liquid and thermally cracked distillate liquid will be available, due to the higher cut temperature of each of these distillate streams. Although the distillate liquid from the FCC process has a relatively high sulfur content because it is derived from a relatively high boiling feed oil, the distillate liquid from the thermal riser cracking operation has a lower sulfur content because it is derived from a relatively low boiling feed oil, so that these two distillate streams can be blended to provide a distillate liquid blend stream of intermediate sulfur content which meets fuel sulfur specifications as a blended stream that the FCC unblended cracked distillate stream by itself might not be able to meet.

Because the thermal cracker burner draws upon the FCC operation for a portion of its fuel requirements, an advantageous fuel distribution between the two cracking operations occurs. While the thermal cracker requires a heat supply of about 350 BTU per pound of feed oil (193 cal/gm), the FCC process requires a heat supply of only about 100 BTU per pound of feed oil (55 cal/gm). In general, the thermal cracker requires an equivalent of about 12 to 15 percent of its total feed oil as process fuel. By drawing upon the lowest grade oil product of the FCC operation as fuel, the thermal cracker not only conserves that portion of its liquid product which is of a relatively higher grade in terms of hydrogen and sulfur content, but also replaces it with a portion of the oil product of a companion cracking process which has a lower fuel requirement and therefore a relatively greater availability of low value fuel oil.

An advantageous mode for processing a total crude oil in accordance with the present invention is to fractionate the crude into three liquid fractions, including a naphtha fraction boiling between about $C_5$ and 400° F. (204° C.), a light gas oil fraction boiling between about 400° and 650° F. (204° and 343° C.), and a 650° F.+ (343° C.+) heavy gas oil or residue fraction. The naphtha fraction is passed through a gasoline reformer and utilized as gasoline. The light gas oil fraction is hydrodesulfurized, if desired, and thermally cracked in accordance with this invention to produce ethylene. The heavy gas oil or residue fraction is first hydrodesulfurized, either alone or together with the light gas oil fraction, and then zeolitically cracked in an FCC operation for conversion to gasoline. The thermal cracking and FCC cracking operations are performed cooperatively in accordance with the present invention. Several means for operating these two cracking operations in a cooperative manner are described herein and any of the described cooperative steps can be employed either together with or independently of the others.

Figure 2:
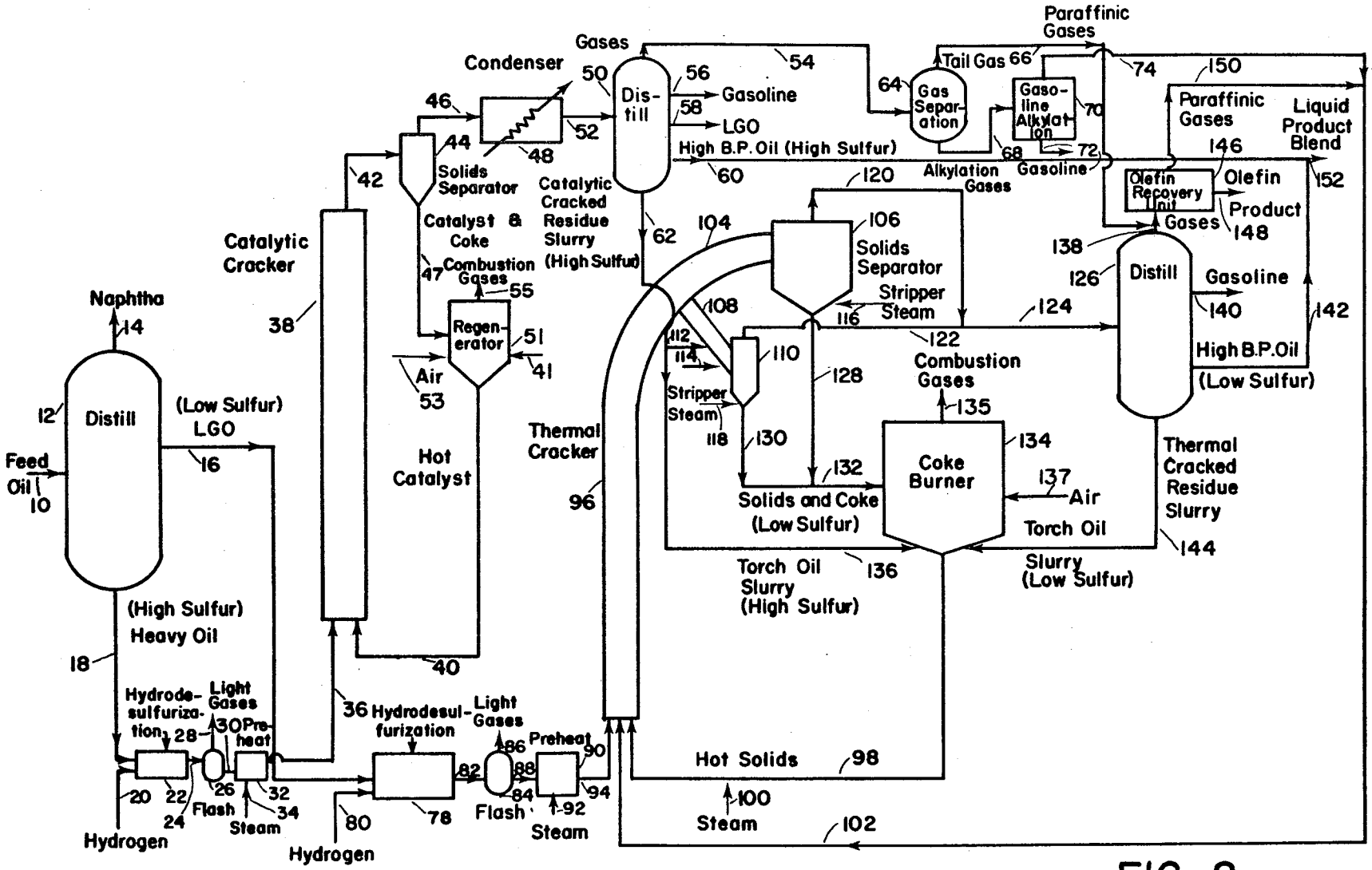

FIG. 2 illustrates the combination thermal and catalytic cracking processes of this invention.

A wide boiling range feed oil is charged through line 10 to feed oil distillation column 12 from which a naphtha stream 14 is removed overhead, a light gas oil (low sulfur) stream is removed through line 16 and a heavy or residual oil (high sulfur) stream is removed through bottoms line 18. The high sulfur heavy oil in line 18 together with hydrogen entering through line 20 are charged through catalytic hydrodesulfurization zone 22. Hydrodesulfurization effluent is removed through line 24 and passed to flash chamber 26 from which impurities including hydrogen sulfide, ammonia and light paraffinic hydrocarbon gases are removed through line 28. The light hydrocarbon gases can be passed to the thermal cracker. Flash residue liquid is removed through line 30 and passed to preheater 32 wherein it is admixed with steam entering through line 34 and the resulting steam-oil mixture is passed through line 36 to the bottom of catalytic cracking riser 38. Hot regenerated zeolite catalyst in line 40 is also added to the bottom of catalytic cracker 38. The oil, steam and zeolite catalyst are passed in entrained flow upwardly through catalytic cracker 38 at a temperature between 900° and 1,100° F. (482° to 593° C.) for a residence time of less than 5 seconds, preferably less than 2 seconds. The reactor linear velocity can be between 25 and 75 feet per second. The amount of steam or other diluent gas charged to the cracker can be 0.5 to 15 weight percent based on hydrocarbon feed. There is essentially no slippage of catalyst relative to vapor flow in the riser. Catalytically cracked effluent is removed overhead through line 42 and passed to solids separator 44 from which cracked products are removed overhead through line 46 while catalyst with coke is separately removed through line 47. The catalyst with coke is passed to regenerator 51 wherein the coke is burned in the presence of an air steam entering through line 53. Makeup catalyst is added to the regenerator through line 41. Regenerator combustion gases are removed overhead through line 55 and their energy is recovered while hot relatively coke free catalyst is removed through line 40 for passage to the bottom of catalytic cracker riser 38.

The gaseous cracked effluent stream in line 46 is passed through condenser 48 wherein it is partially liquefied prior to passage through line 52 to distillation column 50. Light gases are removed overhead from distillation column 50 through line 54 while a gasoline stream is removed through line 56 and a light gas oil stream is removed through line 58. A high boiling point (high sulfur) stream is removed through line 60 for blending with a relatively low sulfur high boiling point oil stream from the thermal cracker, as described below. A high sulfur catalytic cracked residue slurry containing catalyst particles is removed from the bottom of distillation column 50 through line 62 for use as torch oil slurry in the coke burner of the thermal cracker, as described below.

The light gases from distillation column 50 flowing in line 54 are passed to a gas separation chamber 64 from which a tail gas stream is removed overhead through line 66 while an alkylation gas stream is removed through line 68. The tail gas stream comprises hydrogen and $C_1$ through $C_3$, plus a trace of $C_4$, olefins and paraffins. The alkylation gas stream comprises $C_3$ and $C_4$, plus a trace of $C_2$ and $C_5$, olefins and paraffins. The alkylation gas stream is passed through a gasoline alkylation unit 70 employing an acid catalyst, such as sulfuric acid or HF, to convert $C_3$ and $C_4$ olefins and isobutylene to alkylate gasoline which is removed through line 72. A gaseous stream comprising unreacted ethane, propane, isobutane and normal butane is removed from alkylation unit 70 through line 74 for passage to the thermal cracker, as described below.

The low sulfur light gas oil stream from feed oil distillation column 12 passes through line 16 to hydrodesulfurization unit 78 wherein it is catalytically hydrodesulfurized in the presence of hydrogen entering through line 80. Hydrodesulfurization effluent passing through line 82 enters flash chamber 84 from which a stream of light gases containing hydrogen sulfide, ammonia and methane is discharged through line 86. Flash effluent in line 88 passes through preheater 90 and is admixed with steam entering through line 92 for passage through line 94 to the bottom of thermal cracker riser 96. Hot solids in line 98 and steam entering through line 100 is also charged to the bottom of thermal cracker 96. The aforementioned stream comprising propane and normal butane in line 74 from catalytic cracker 38 and alkylation unit 70 together with thermal cracker recycle gases is also charged to the bottom of thermal cracker 96 through line 102.

The cracker riser 96 is provided with a curved discharge segment 104 at the top of the riser to induce centrifugal separation of solids in advance of solids separator-stripper 106. Thermal riser 96 is also provided with an axial main gas recovery conduit 108 which contains a reduced concentration of solids leading to a solids separator-stripper 110. Quench slurry can enter conduit 108 from line 62 through line 112, or a different quench fluid can enter through line 114. Stripper steam is charged to solids separator 106 through line 116 and is charged to solids separator 110 through line 118.

Thermally cracked effluent is removed overhead from solids separator 106 through line 120. Another portion of thermally cracked effluent is removed overhead from solids separator 110 through line 122. The cracked products in lines 120 and 122 are blended in line 124 and charged to cracked products distillation column 126. Solids recovered from solids separator 106 fall through line 128 while solids recovered from solids separator 110 fall through line 130. These two solids streams are blended in line 132 to provide a solids and coke (low sulfur) stream for passage to coke burner 134. The torch oil (high sulfur) catalyst slurry in line 62 is also passed to coke burner 134 through line 136. Combustion gases are discharged from coke burner 134 through line 135 for passage to an energy recovery system.

The effluent streams from distillation column 126 include a gaseous overhead stream 138, a gasoline stream 140, and a high boiling point oil (low sulfur) stream in line 142. Distillation column 126 produces a thermally cracked residue slurry stream containing inert solid particles which comprises a low sulfur torch oil which is passed through line 144 to burner 134. Water condensed in column 126 is ultimately recycled as diluent steam.

The light thermally cracked gases in line 138 are blended with the $C_1$ through $C_3$ olefinic and paraffinic tail gas stream from catalytic cracker 38 in line 66 and passed through an olefin recovery unit 146 which comprises a series of distillation zones. In this manner, a single olefin recovery operation is utilized to separate the light olefins and paraffins contained in both cracked product streams so that the light paraffins from the catalytic cracker as well as from the thermal cracker can be recycled to the thermal cracker. A total olefin product from both catalytic and thermal cracking operations is recovered through line 148 while the total paraffinic gases are removed through line 150 and blended with the catalytic cracked paraffinic gases in line 74. The blended gaseous paraffinic stream in line 102 from lines 74 and 150 is passed to the bottom of thermal riser 96. The high boiling point (low sulfur) thermally cracked oil in line 142 is blended with the high boiling point (high sulfur) catalytically cracked oil in line 60 to give a high boiling point intermediate sulfur liquid product blend in line 152.

In a variation of the process, line 54 can be directed to olefin recovery unit 146, by-passing gas separator 64. In this variation, butenes, and possibly propylene, can be recovered from olefin stream 148 and passed to alkylation unit 70. This embodiment provides the advantage of eliminating gas separator 64.

Although a fully integrated combination catalytic and thermal cracking operation is described, it is to be noted that each of the three interdependent features described herein can be employed either together with or exclusively of the others, if desired. For example, the feature of utilizing slurry residual oil from the catalytic cracker to augment the slurry residual oil from the thermal cracker as torch oil to permit an increase in the cut temperature of both slurry streams and thereby provide a wider boiling range blended stream of high boiling point distillate liquid product containing an intermediate sulfur level, can be employed independently of the other features. Also, the feature of utilizing an alkylation unit to provide a novel feed stream comprising concentrated paraffins from catalytic cracking for a thermal cracker can be independently employed. Finally, the passage of the catalytically cracked tail gas stream through the thermal cracker olefin recovery unit to prepare a novel recycle stream for a thermal cracker which includes concentrated paraffins from catalytic cracking can be independently employed. Because each of these three features can be employed independently of the others in a combination catalytic-thermal cracking operation, each is in the subject of a separate co-filed patent application.

We claim:

1. A combination catalytic and thermal cracking process comprising catalytically cracking a relatively high boiling relatively high sulfur hydrocarbon feed oil comprising a 650° F.+ heavy gas oil or residual oil in the presence of entrained zeolite cracking catalyst at a temperature between about 900° and 1,100° F. and recovering catalytically cracked effluent including catalytically cracked liquid product, separating said catalytically cracked liquid product into a catalytically cracked residue liquid containing slurried catalyst particles and a catalytically cracked distillate liquid; thermally and non-catalytically cracking a lower boiling and lower sulfur hydrocarbon feed oil to produce ethylene in the presence of entrained catalytically inert hot solids and a gaseous diluent at a temperature between about 1,300° and 2,500° F. and recovering a thermally cracked effluent including gaseous products and thermally cracked liquid product, injecting said catalytically cracked residue liquid containing slurried catalyst particles into said thermally cracked effluent to thermally quench said thermally cracked effluent, recovering coke-laden solids from said thermally cracked effluent, passing said coke-laden solids to a coke burner, separating said thermally cracked liquid product into a thermally cracked residue liquid containing catalytically cracked residue liquid and slurried solids and a thermally cracked distillate liquid; and passing said thermally cracked residue slurry liquid containing catalytically cracked residue liquid and slurried solids to said coke burner for combustion as burner fuel.

2. The process of claim 1 including the step of blending said catalytically cracked distillate liquid and said thermally cracked distillate liquid to provide a blended liquid fuel.

3. The process of claim 1 wherein said catalytic and thermal cracking steps are each performed in a vertical riser.

4. The process of claim 1 wherein the residence time of said thermal cracking step is 0.05 to 2 seconds.

5. The process of claim 1 wherein said gaseous diluent is steam.

6. The process of claim 1 wherein flue gas emitted from said burner contains less than 500 ppm by volume of sulfur oxides.

7. The process of claim 2 wherein said blended liquid fuel upon combustion emits a flue gas containing less than 500 ppm by volume of sulfur oxides.

8. The process of claim 1 wherein the lower boiling feed oil comprises a 400° to 650° F. light gas oil.

* * * * *